US006949740B1

(12) United States Patent
Sheehan et al.

(10) Patent No.: US 6,949,740 B1
(45) **Date of Patent: *Sep. 27, 2005**

(54) LAMINATED LENS FOR INTRODUCING GAS-PHASE IONS INTO THE VACUUM SYSTEMS OF MASS SPECTROMETERS

(76) Inventors: Edward William Sheehan, Chem-Space Associates, Inc. 655 William Pitt Way, Pittsburgh, PA (US) 15238; Ross Clark Willoughby, Chem-Space Associates, Inc., 655 William Pitt Way, Pittsburgh, PA (US) 15238

( * ) Notice: Subject to any disclaimer, the term of this patent is extended or adjusted under 35 U.S.C. 154(b) by 73 days.

This patent is subject to a terminal disclaimer.

(21) Appl. No.: 10/661,842

(22) Filed: Sep. 12, 2003

Related U.S. Application Data

(60) Provisional application No. 60/410,653, filed on Sep. 13, 2002.

(51) Int. Cl.[7] ..... H01J 49/16

(52) U.S. Cl. ..... 250/288; 250/287; 250/286; 250/282

(58) Field of Search ..... 250/288, 282, 250/287, 286, 281, 292

(56) References Cited

U.S. PATENT DOCUMENTS

| | | | | |
|---|---|---|---|---|
| 4,300,004 A | | 11/1981 | Iribane et al. | |
| 4,318,028 A | | 3/1982 | Perel et al. | |
| 4,531,056 A | | 7/1985 | Labowsky et al. | |
| 4,542,293 A | | 9/1985 | Fenn et al. | |
| 5,306,910 A | | 4/1994 | Jarrell et al. | |
| 5,412,208 A | | 5/1995 | Covey et al. | |
| 5,559,326 A | | 9/1996 | Goodley et al. | |
| 5,747,799 A | * | 5/1998 | Franzen | 250/288 |
| 5,750,988 A | | 5/1998 | Apffel et al. | |
| 5,838,002 A | | 11/1998 | Sheehan | |
| 5,986,259 A | * | 11/1999 | Hirabayashi et al. | 250/288 |
| 6,107,628 A | * | 8/2000 | Smith et al. | 250/292 |
| 6,278,111 B1 | | 8/2001 | Sheehan et al. | |
| 6,455,846 B1 | | 9/2002 | Prior et al. | |
| 6,583,408 B2 | * | 6/2003 | Smith et al. | 250/288 |
| 2002/0011560 A1 | * | 1/2002 | Sheehan et al. | 250/283 |
| 2003/0038236 A1 | | 2/2003 | Russ et al. | |
| 2003/0197121 A1 | * | 10/2003 | Turecek et al. | 250/281 |

FOREIGN PATENT DOCUMENTS

| | | |
|---|---|---|
| WO | WO 98/07505 | 2/1998 |
| WO | WO 03/010794 A2 | 2/2003 |

OTHER PUBLICATIONS

U.S. Appl. No. 10/688,021, (Sheenan et al) filed Oct. 17, 2003.*

Potjewyd, J., "Focusing of ions in atmospheric pressure gases using electrostatic fields," Ph.D. Thesis, University of Toronto (1983).

(Continued)

*Primary Examiner*—John R. Lee
*Assistant Examiner*—Johnnie L Smith, II

(57) ABSTRACT

An improved lens for collecting and focusing dispersed charged particles or ions having a stratified array of elements at atmospheric or near-atmospheric pressure, each element having successively smaller apertures forming a tapered terminus, wherein the electrostatic DC potentials are applied to each element necessary for focusing ions through the stratified array for introducing charged particles and ions into the vacuum system of a mass spectrometer. Embodiments of this invention are methods and devices for improving sensitivity of mass spectrometry when coupled to both high and low electrostatic field atmospheric pressure ionization sources.

19 Claims, 11 Drawing Sheets

OTHER PUBLICATIONS

Mahoney, J.F., et al., "A theoretical and experimental basis for producing very high mass biomolecular ions by electrohydrodynamic emission," 22th IEEE Industry Applications Society Annual Meeting, Atlanta, GA, Oct. 18–23, 1987.

Olivares, J.A., et al., "On–line mass spectrometric detection for capillary zone electrophoresis," Anal. Chem. 59, pp. 1230–1232 (1987).

Lee, T.D., et al., "An EHD source for the mass spectral analysis of peptides," Proceedings of the 36th ASMS Conference on Mass Spectrometry and Allied Topics, San Francisco, CA, Jun. 5–10, 1988.

Smith, R.D., et al., "Capillary zone electrophoresis–mass spectrometry using an electrospray ionization interface," Anal. Chem. 60, pp. 436–441 (1988).

Lee, T.D., et al., "Electrohydrodynamic emission mass spectra of peptides," Proceedings of the 37th ASMS Conference on mass Spectrometry and Allied Topics, Miami Beach, FL, May 21–26, 1989.

Mahoney, J.F., et al., "Electrohydrodynamic ion source design for mass spectrometry: Ionization, ion optics and desolvation," Proceedings of the 38th ASMS Conference on Mass Spectrometry and Allied Topics, Tucson, AR, Jun. 3–8, 1990.

Bruins, A.P., "Mass Spectrometry with ion sources operating at atmospheric pressure," Mass Spectrom. Rev. 10, pp. 53–77 (1991).

Feng, X., et al., "Single isolated droplets with net charge as a source of ions," J. Am. Soc. Mass Spectrom, 11, pp. 393–399 (2000).

Schneider, B.B., et al., "An atmospheric pressure ion lens to improve electrospray ionization at low solution flow–rates", Rapid Commun. Mass Spectrom 15, pp. 2168–2175 (2001).

Alousi, A., et al., "Improved transport of atmospheric pressure ions into a mass spectrometer," The Proceedings of the 50th ASMS Conference on Mass Spectrometry and Allied Topics, Orlando, Florida, Jun. 2–6, 2002.

Klesper, H., et al., "Intensity increase in ESI MS by means of focusing the spray cloud onto the MS Orifice," The Proceeding of the 50th ASMS Conference on Mass Spectrometry and Allied Topics, Orlando, Florida, Jun. 2–6, 2002.

Schneider, B.B., et al., "An atmospheric pressure ion lens that improves nebulizer assisted electrospray ion sources", J. Am. Soc. Mass Spectrom. 13, pp. 906–913 (2002).

* cited by examiner

1A

1B

4A

4B

7A

7B

7C

LAMINATED LENS FOR INTRODUCING GAS-PHASE IONS INTO THE VACUUM SYSTEMS OF MASS SPECTROMETERS

CROSS-REFERENCE TO RELATED APPLICATIONS

This application is entitled to the benefits of provisional Patent Applications Ser. No. 60/410,653 filed Sep. 13, 2002.

RELEVANT CO-PENDING APPLICATIONS

Provisional Patent Applications Ser. No. 60/210,877 filed Jun. 9, 2000 and patent application Ser. No. 09/877,167 filed Jun. 8, 2001, now U.S. Pat. No. 6,744,041 issued 2004 Jun. 1, and provisional Patent Applications Ser. No. 60/384,869 filed Jun. 1, 2002, now patent application Ser. No. 10/499, 147 filed May 31, 2003.

FEDERALLY SPONSORED RESEARCH

The invention described herein was made with United States Government support under Grant Number: 1 R43 RR143396-1 from the Department of Health and Human Services. The U.S. Government may have certain rights to this invention.

SEQUENCE LISTING OR PROGRAM

Not Applicable

BACKGROUND OF THE INVENTION—FIELD OF INVENTION

This invention relates to laminated lenses which are used for interfacing atmospheric pressure ionization sources to atmospheric inlets, such as apertures and glass capillaries, leading into mass spectrometers and ion mobility spectrometers.

BACKGROUND OF THE INVENTION

Dispersive sources of ions at or near atmospheric pressure; such as, atmospheric pressure discharge ionization, chemical ionization, photoionization, or matrix assisted desorption ionization, and electrospray ionization have low sampling efficiency through conductance or transmission apertures, where less than 1% [often less than 1 ion in 10,000] of the ion current emanating from the ion source make it into the lower pressure regions of the present interfaces for mass spectrometry. Thereafter, scientists have devised several means of delivering and transferring gas-phase ions from atmospheric pressure sources into the vacuum system of mass spectrometers, such as, using lower flow sprayers to form very small droplets [referred to as nanospray], using increased heating of the aerosols to generate more ions [such as the commercial product, TurboSpray by PE-Sciex], increasing the sampling diameter of the sampling aperture at the atmospheric-lower pressure interface, and using electrostatic, electrodynamic, or aerodynamic lens at atmospheric pressure to focus highly charged liquid jets, aerosols of droplets and ion clusters, and gas-phase ions.

Larger Entrance Aperture and Inlet Aperture Shape

Bruins (1991) summarizes several means for transferring ions from an atmospheric ion source into the vacuum system of a mass spectrometer: shape of lens and orifice size. Inlet apertures in a flat disk and in the tip of a cone pointed toward the ion source are presently the preferred means of ion sampling through various aperture configurations. By increasing the diameter of the inlet aperture, more ions are drawn into the aperture—the increase being related to the increase in gas conductance. However, by increasing the conductance aperture diameter, larger pumps are required to maintain the pressure in the lower pressure regions, thereby, increasing the system and operating costs of mass spectrometers. This is also the case for ion mobility spectrometers when operated at reduced pressure.

U.S. Pat. No. 6,455,846 B1 to Prior et al. (2002) discloses a flared or horn inlet for introducing ions from an atmospheric ionization chamber into the vacuum chamber of a mass spectrometer. They also reported that the increase in ion current recorded in the mass spectrometer was directly proportional to the increase in the opening of the flared inlet.

Electrical and Aerodynamic Lens

Ion movement at higher pressures is not governed by the ion-optical laws used to describe the movement of ions at lower pressures. At lower pressures, the mass of the ions and the influence of inertia on their movement play a prominent role. While at higher pressures the migration of ions in an electrical field is constantly impeded by collisions with the gas molecules. In essence at atmospheric pressure there are so many collisions, that the ions have no "memory" of previous collisions and the initial energy of the ion is "forgotten". Their movement is therefore determined by the direction of the electrical field lines and the viscous flow of gases. At low viscous gas flow, the ions follow the electric field lines [the situation at the entrance to apertures and capillaries], while at higher viscous gas flow the movement is in the direction of the gas flow. Inventors [as discussed below] have disclosed various means of moving ions at atmospheric pressure by shaping the electric field lines and directing the flow of gases.

Housing Lens

Inventors have proposed shaping the electrostatic field lines in front of the inlet aperture using electrodes at a substantial distance from both the sprayer and the inlet aperture. U.S. Pat. No. 5,432,343 to Gulcicek et al. (1995) discloses a cylindrical electrostatic lens in the atmospheric ionization chamber at an electrostatic potential greater than the sprayer, the inlet aperture, and the end of a glass capillary coated with a metal surface that shapes the electrostatic field lines within the ionization or evaporation chamber. U.S. Pat. No. 5,559,326 to Goodley et al (1996) and U.S. Pat. No. 5,750,988 to Apffel et al. (1998) both disclose a needle electrode in front of the inlet aperture and an electrified housing surrounding the sprayer. All of this work was for the purpose of shaping the electrostatic field lines in front of the sampling aperture to be either perpendicular to or converging onto the inlet aperture, however, these configurations require the position of the sprayer or needle relative to the sampling aperture to be set and predetermined so as to obtain maximum ion sampling. Forcing the operator of the instrument to place the sprayer back in the original position or to reoptimize the potentials to return to the original operating conditions.

Atmospheric Pressure: Lens at Sprayer

Several types of ring or planar electrodes at the sprayer have been proposed to focus ions and charged droplets after they leave the sprayer. U.S. Pat. No. 4,531,056 to Labowsky et al. (1985) discloses a perforated diaphragm used to direct the flow of a gas at an electrospray needle to aid the evaporation of highly charged droplets emanating from the needle and sweep away gas-phase solvent molecules from the area in front of the inlet aperture. In addition, the diaphragm was used to stabilize the position of the needle to direct the liquid jet through a center aperture in the diaphragm into a desolvation or ionization region.

Schneider et al. (2001, 2002) discloses a ring shaped electrode incorporated near the tip of the electrospray needle which increased the detected ion signal and the stability of the signal and at the same time decreasing the dependence of the ion signal on the sprayer position.

Low Pressure: Lens at Sprayer

Similar types of electrodes have been disclosed to increase the ion signal of gas, electrospray sources operated at lower pressures—for example, in U.S. Pat. No. 4,318,028 to Perel et al. (1982), Mahoney et al. (1987, 1990), and Lee et al. (1988, 1989). Our own patents U.S. Pat. Nos. 5,838,002 (1998) and 6,278,111 B1 (2001), and World patent 98/07505 (1998) describes a concentric tube which surrounds the end of the electrospray capillary which was used to stabilize the direction of the liquid jet in order to direct the liquid jet into a heated high pressure region where the jet broke up into small droplets and where gas-phase ions and ion clusters were formed. This approach proved feasible but it was found to difficult to control the collection and focusing of ions formed in this higher-pressure region due to the electrical breakdown of the gases.

Atmospheric Pressure Lens: Between Sprayer & Aperture; or at Aperture

Several types of ring or planar electrodes positioned between the sprayer and an inlet aperture have been proposed to focus ions and charged droplets: U.S. Pat. No. 4,300,044 to Iribane et al. (1981) and U.S. Pat. No. 5,412,208 to Covey et al. (1995) are examples of placing an electrified lens immediately in front of the inlet aperture; U.S. Pat. No. 4,542,293 to Fenn et al. (1985) and U.S. patent application 2003/0,038,236 to Russ et al. (2003) disclose diaphragm and planar electrodes in front of a heated capillary inlet; and U.S. Pat. No. 5,747,799 to Franzen (1998) discloses a ring electrode on the inside wall of a heated capillary inlet in conjunction with the shape of the aperture to entrain ions into the aperture by viscous friction. Olivares et al. (1987, 1988) discloses a focusing ring located downstream of the electrospray sprayer, and U.S. Pat. No. 5,306,910 to Jarrell et al. (1994) discloses a gird which is operated with an oscillating electrical potential to form gas-phase ions from highly charge droplets, while allowing the electrospray needle and entrance aperture to remain at ground potential; however, most of the droplets impacted on the grid as they pass through the grid, not making it into the inlet aperture. Feng et al. (2002) describes a series of annular electrodes downstream of an induction electrode used to guide charged droplets, and Alousi et al. (2002) describes a lens between the electrospray needle and the entrance aperture dividing the ion source into two discrete areas—an area for the creation of highly charged droplets and gas-phase ions and a drift region leading to an increase of 2–10 fold in the signal intensity; however, most of the ion current from the sprayer was deposited on the lens.

World patent 03/010794 A2 to Forssmann et al. (2003) discloses a series of annular electrodes for ion acceleration and then subsequent ion focusing in front of the inlet aperture, similar to the device described by Jarrell et al. (1994). Jarrell et al.'s device utilize an oscillatory potential while Forssmann et al.'s device utilizes a direct current potential to first accelerate charged drops away from the electrospray needle, through an aperture in an accelerating electrode [or through an accelerating grid in Jarrell et al.'s device], and then into a focusing region. In both cases, droplets are accelerated away from an electrospray needle and travel up a potential gradient into a focusing region due their momentum. Droplets and any gas-phase ions resulting from the breakup of the droplets would more than likely impact on the accelerating electrodes due to the diverging electrostatic fields along the axis of the electrodes.

Our U.S. Pat. No. 6,744,041 (2004), and patent application Ser. No. 10/499,147 (2003) describe perforated high transmission surfaces [both single layer and laminated] with large electrostatic potential differences across the structure [typically >10/1] for transferring ions from dispersive atmospheric ionization sources into a focusing region where the ions can be focused into a small cross-sectional ion beam for introduction into an inlet aperture. Nevertheless all the atmospheric tens, electrodes, grids, and perforated structures heretofore known suffer from a number of disadvantages:

(a) By using larger inlet apertures to increase the flow of ions into the vacuum system, and the necessary vacuum pumping system to maintain low pressures required for operation of the mass spectrometer, the initial and operating cost of the instrument is expensive.

(b) The lens and electrodes between the ion source and the inlet aperture in present use, with small electrical potential differences across the structure, are very inefficient in transferring ions from one region to another, leading to a small percentage [<1%] of the ion current from the ion source making it into the inlet aperture and the majority of the ion current impacting on the lens and the inlet aperture.

(c) Surfaces, single layer and laminated, with large electrostatic potential differences across the surface are very efficient at collecting and focusing dispersive highly charged aerosols into beams with small cross-sections but the diverging fields encountered at inlet apertures, due to large electrostatic difference between the surfaces and the inlet, can lead to the lose of ions.

(d) By operating high electrostatic field ion sources or spray chambers, such as electrospray and discharge sources, with cylindrical electrodes and needles, distal to the inlet aperture, the potentials of the lens required to focus the ions is larger than the potential of the ion source thereby operating the electrodes at potentials close to their discharge limit. In addition, the position of the sprayers or nebulizers is pre-set requiring re-optimization of the potentials every time the sprayer's original position is change.

(e) By the positioning lenses or diaphragms immediately in front of or behind the inlet aperture, most of the ion current from the sprayers ends up on the lens itself or on the entrance of the inlet aperture because these lenses cannot overcome the dispersive electrical potentials of the sprayers or nebulizers.

(f) By positioning a single lens or perforated electrode between the ion source and the inlet aperture there is no way to dynamically shape or readjust the electrostatic filed lines in the focusing region between the lens and the inlet aperture.

BACKGROUND OF INVENTION—OBJECTS AND ADVANTAGES

Accordingly, besides the objects and advantages of the laminated and single layer high transmission surfaces described in our co-pending and issued patents, several objects and advantages of the present invention are:

(a) to provide a laminated lens that can be easily incorporated into various atmospheric ion sources in order to shape the electrostatic fields lines in front of an inlet aperture for the purpose of focusing ions into the inlet aperture of an atmospheric interface for a mass spectrometer;

(b) to provide a laminated lens and a high transmission surface that will establish a focusing region of converging electrostatic fields in front of an inlet aperture that is not dominated by the electrostatic fields emanating from the ion source region but by the laminated lens and inlet aperture;

(c) to provide a laminated lens to focus a substantial proportion of ions from the ion source into the inlet aperture and into the vacuum system of a mass spectrometer without the need to enlarge the inlet aperture to get more ions into the vacuum system;

(d) to provide dynamic focusing or shaping of the electrostatic field lines between high transmission surface and the inlet aperture which can focus a substantial proportion of the ions into the inlet aperture, (e) to provide to the operator a user controllable or tunable field ration across single or laminated high transmission elements that results in improved transmission efficiency across thigh transmission elements into funnel-well regions, (f) to a wider acceptance cross-section when sampling large volume sources that are being collected into the laminated lens, (g) to provide improved compression in funnel-well optical systems as described in our issued U.S. Pat. No. 6,744,041 (Jun. 1, 2004), and our co-pending patent applications Ser. No. 60/384,869 filed 2002 Jun. 1, now patent application Ser. No. 10/499,147 filed 2003 May 31; and Ser. No. 60/384,864 filed 2002 Jun. 1, now Ser. No. 10/449,344, filed 2003 May 30.

(h) to reduce the well depth requirement for funnel-well optical devices which create problems with high voltage safety and isolation.

Further objectives and advantages are to provide a lens which can be easily and conveniently incorporated into existing atmospheric interfaces without the need for extensive or major reconstruction of the interface, which is simple to operate and inexpensive to manufacture, which can be used with highly dispersive or low electrostatic or electrodynamic field ion sources, and which obviates the need to have the sprayer's and or lens' placement or orientation preset. Still further objects and advantages will become apparent from a consideration of the ensuing descriptions and drawings.

SUMMARY

In accordance with the present invention a laminated lens comprises alternate layers of conducting electrodes and insulating bases with upstream or entrance aperture of the lens being larger than the exit aperture, with an optional high transmission surface upstream of the laminated lens for the introduction of gas-phase ions or charged particles at or near atmospheric pressure into atmospheric inlets, such as apertures and capillaries, to mass or ion mobility spectrometers. The voltages applied to conducting electrodes and high transmission surface are intended to provide a funnel-shaped potential surface of user definable initial and exit potentials relative to the source of ions and inlet into atmospheric inlets.

DRAWING FIGURES

REFERENCE NUMERALS IN DRAWINGS

| | |
|---|---|
| 10 | metal laminate or layers |
| 20 | base |
| 30 | laminate/base inner surface |
| 40 | largest aperture |
| 50 | smallest aperture |
| 60 | aperture |
| 70 | element |
| 80 | ion-collection region |
| 90 | deep-well focusing region |
| 92 | deep-well ring insulator |
| 94 | metal laminate |
| 100 | source |
| 110 | delivery means |
| 120 | ion-source |
| 124 | laser |
| 126 | sample target |
| 130 | ion-source entrance wall |
| 140 | ion-source cylindrical wall |
| 142 | cylindrical electrode |
| 144 | shielding electrode |
| 150 | ring insulator |
| 152 | ring insulator |
| 160 | ion-source region |
| 162 | generalized ion trajectories |
| 170 | second ring insulator |
| 172 | ring insulator |
| 200 | concurrent gas source |
| 202 | concurrent gas inlet |
| 204 | countercurrent gas source |
| 206 | countercurrent gas inlet |
| 208 | exhaust destination |
| 210 | exhaust outlet |
| 300 | Lam-HTE |
| 310 | inner-electrode surface |
| 320 | outer-electrode surface |
| 322 | metal circular laminate |
| 330 | second insulating base |
| 340 | particle-stop |
| 344 | circular metal laminate |
| 350 | funnel-focusing electrode |
| 352 | circular electrode |
| 360 | laminated openings |
| 400 | funnel-focusing region |

-continued

| | |
|---|---|
| 401 | metal laminate |
| 410 | cylindrical funnel wall |
| 412 | ring insulator |
| 414 | second ring insulator |

DETAILED DESCRIPTION—FIGS. 1 THRU—PREFERRED EMBODIMENT

Figure 1:
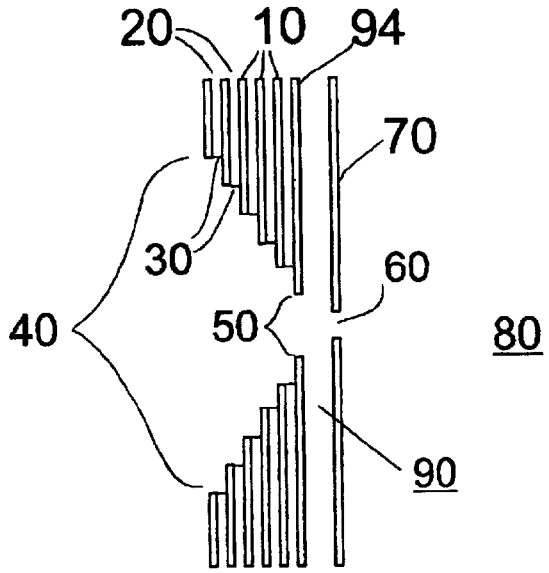
FIGS. 1A and 1B shows a cross-sectional illustration of a laminated lens for introducing charged particles into the aperture of a (1A) planar lens, and (1B) a glass tube coated with a metal coating.
Figure 1:
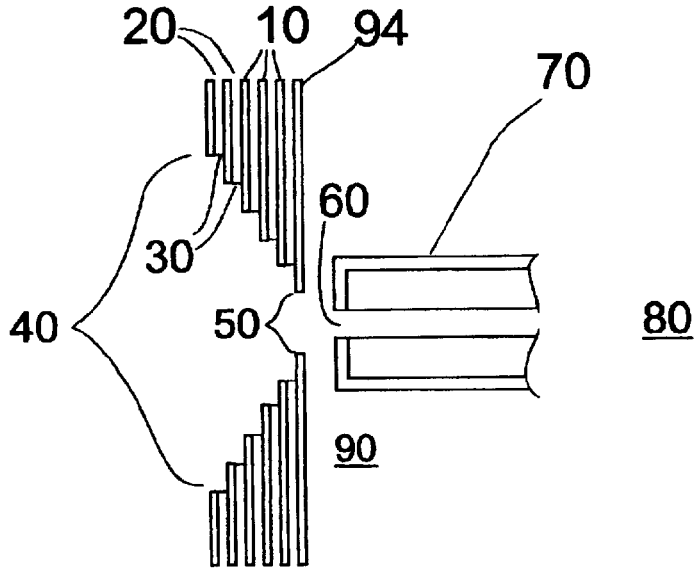
Figure 2:
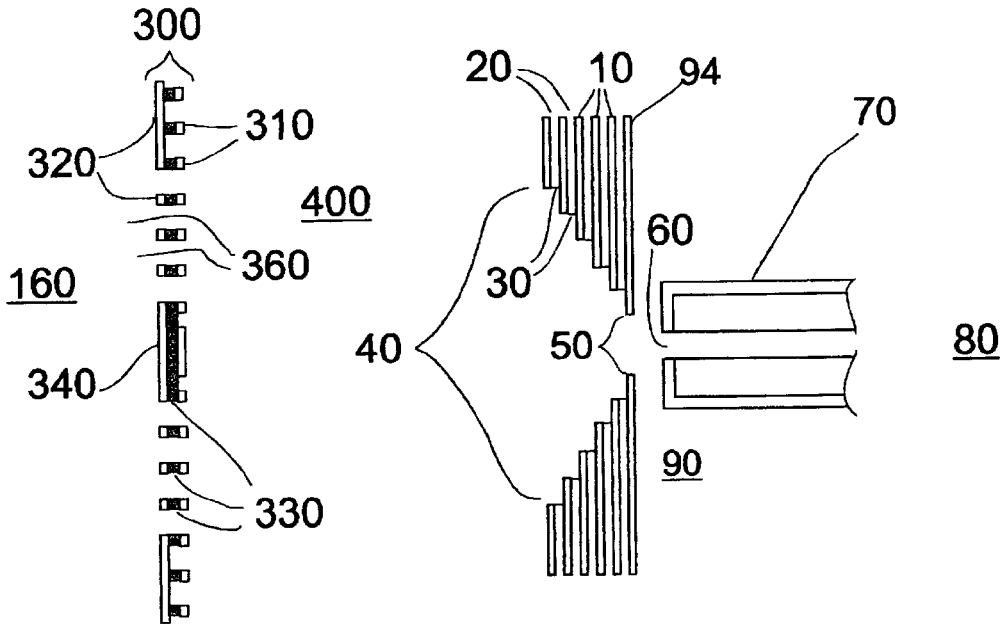
FIG. 2 shows a similar lens configured with a laminated high-transmission element (Lam-HTE).
Figure 3:
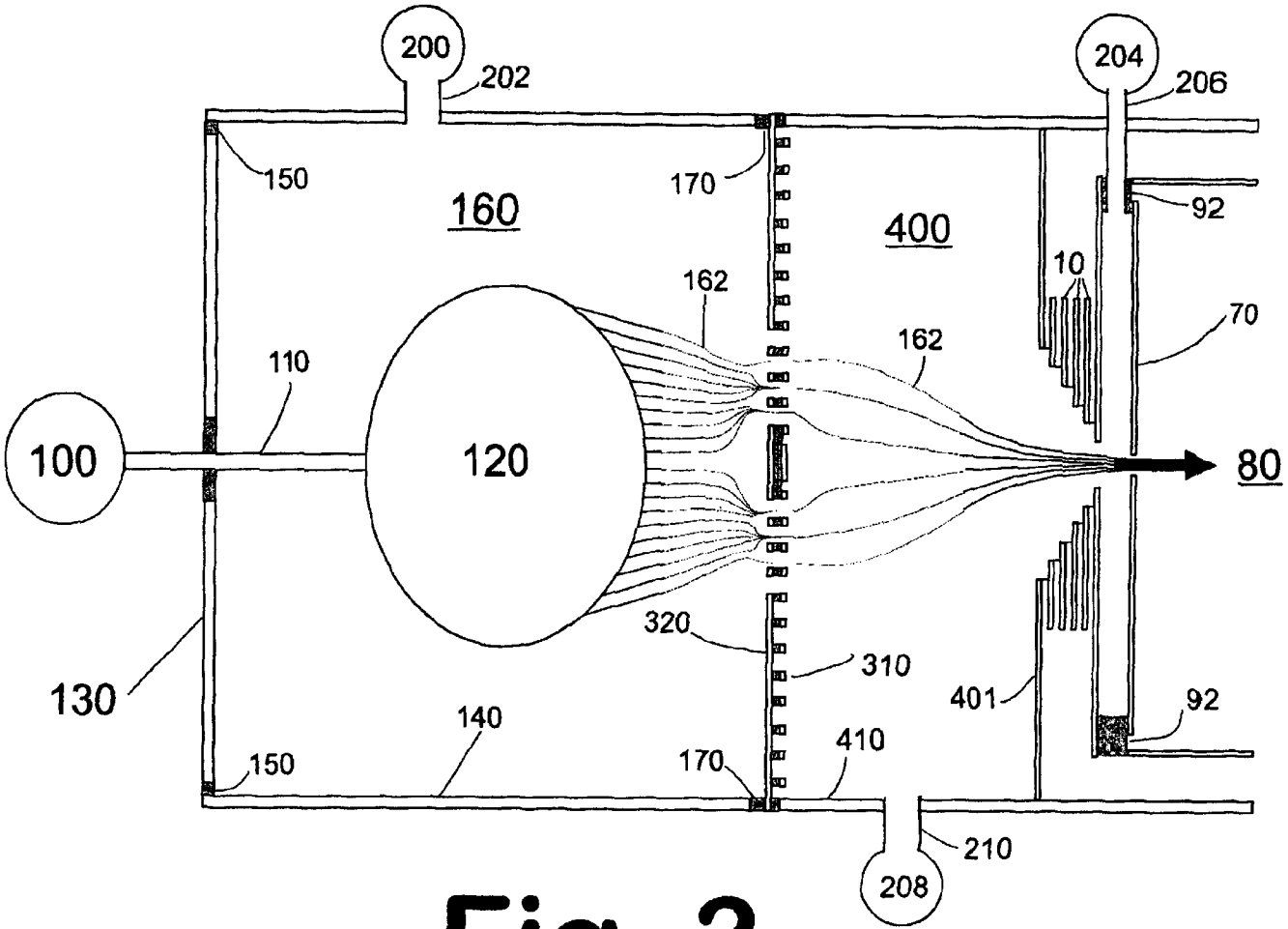
FIG. 3 shows a similar lens configured with a laminated high-transmission element (Lam-HTE) and an atmospheric pressure ionization source.
Figure 4:
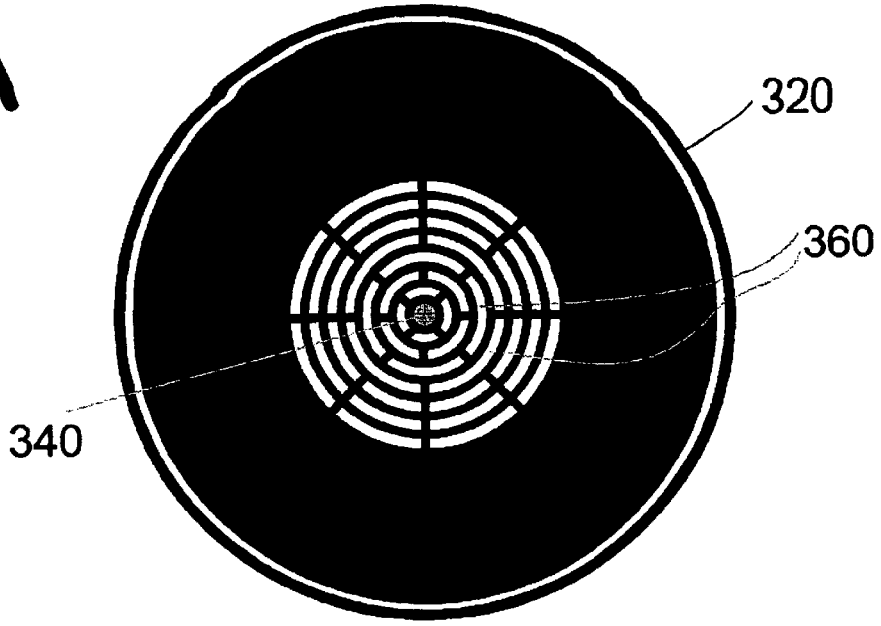
FIG. 4 shows the laminated high-transmission element (Lam-HTE) with slotted aperture openings: showing outer-laminated surface (4A) and inner-laminated surface (4B).
Figure 4:
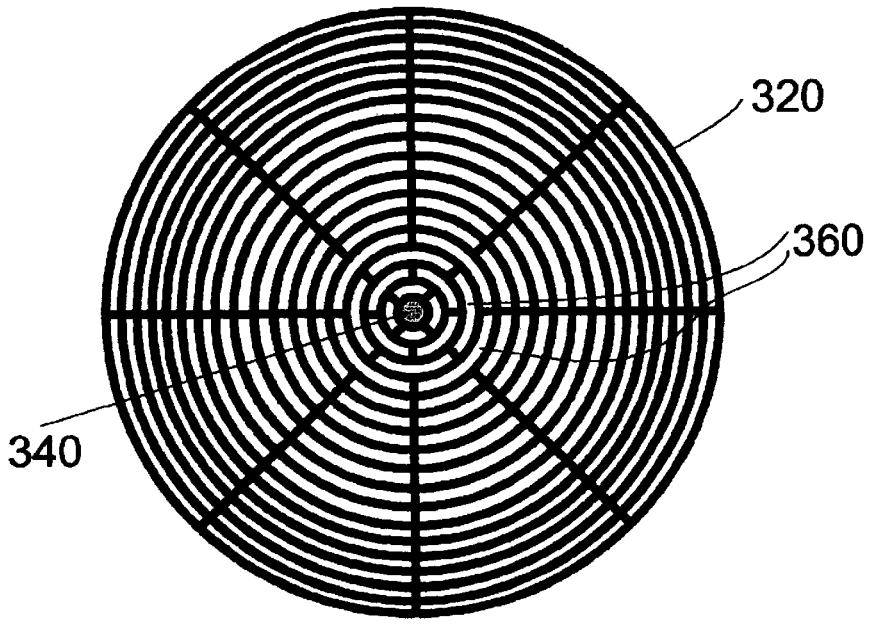

A preferred embodiment of the laminated-lens, funnel lens or just lens of the present invention is illustrated in FIGS. 1A, 1B, and 2. The lens is made-up of a series of thin concentric circular planar metal laminates or layers 10 separated from each other by a thin circular base 20 of uniform cross section consisting of nonconducting insulating material, each metal laminate/base pair having an aperture, defined by a laminate/base inner surface 30. In this series of metal laminates and insulating bases, each adjacent aperture has a smaller diameter than the previous aperture, the collection of the apertures thus forming a funnel shaped lens. The lens thus has an entry, corresponding with the largest aperture 40, and an exit, corresponding with the smallest aperture 50 for introducing gas-phase ions or charged particles into a deep-well region 90 where they are accelerated toward an aperture 60 in the wall of an element 70. The ions are transferred to an ion-collection region 80 through aperture 60. Element 70 is isolated from the metal laminate 94 of the funnel lens by a deep-well ring insulator 92. The deep-well focusing region 90 is bounded by metal laminate 94, element 70, and deep-well ring insulator 92.

Aperture 60 has a diameter appropriate to restrict the flow of gas into region 80. In the case of vacuum detection, such as mass spectrometry in region 80, typical aperture diameters are 100 to 1000 micrometers. The collection region 80 in this embodiment is intended to be the vacuum system of a mass spectrometer (interface stages, optics, analyzer, detector) or other low-pressure ion and particle detectors.

In the preferred embodiment, the base 20 is glass. However the base can consist of any other material that can serve as a nonconductive insulator, such as nylon, Vespel, ceramic, various impregnated or laminated fibrous materials, etc. Alternatively, the base can consist of other nonconductive or dielectric material, such as ferrite, ceramics, etc. The metal laminates 10 are fabricated from a conducting and chemically inert material, such as stainless steel, brass, copper, aluminum, etc. While element 70 can also be made of a conducting material, such as stainless steel, aluminum, etc, or a conductively coated insulating material, such as the glass tube.

Upstream of the lens is a funnel focusing region 400, a laminated high transmission element 300, and an ion-source region 160 of gas-phase ions or charged particles formed at or near atmospheric pressure. Sample from a source 100 is delivered to an ion-source 120 by a delivery means 110 through an ion-source entrance wall 130. Wall 130 is electrically isolated from an ion-source cylindrical wall 140 by a ring insulator 150 while a second ring insulator 170 isolates cylindrical wall 140 from a laminated high-transmission element 300. Sample from source 100 are gas-phase ions or charged particles or, alternatively, are neutral species, which are ionized in the ion-source 120. Ion-source region 120 is bounded by the wall 130, the cylindrical wall 140, and the laminated high-transmission element or Lam-HTE 300.

The high-transmission element (Lam-HTE) 300 consist of a second insulating base 330 laminated with an inner-electrode 310 and an outer-electrode 320 metal laminate. The surface of the laminated high transmission element (Lam-HTE) has slotted shaped laminated openings 360 through which gas-phase ions are transmitted from the ion-source region 120 to the funnel-focusing region 400. Funnel-focusing region 400 is bounded by a cylindrical funnel wall 410, the inner-electrode surface 310 of the laminated high-transmission element (Lam-HTE) 300, and metal laminate 401 establishing the largest aperture 40 of the laminated lens. On the surface of the outer laminate 320 is a raised particle-stop 340, which is axial symmetric with apertures 40, 50, 60.

In the preferred embodiment, the second base 320 is also glass. However the base can consist of any other material that can serve as an electrical insulator, such as nylon, Vespel, ceramic, various impregnated or laminated fibrous materials, etc. The metal laminates 310, 320 are fabricated from a conducting and chemically inert material, such as stainless steel, brass, copper, aluminum, etc. Alternatively, the laminated element (Lam-HTE) 300 may be manufactured by using the techniques of microelectronics fabrication: photolithography for creating patterns, etching for removing material, and deposition for coating.

A DC (direct current) potential is applied to each metal laminate, electrode, and element creating an electrical field, although a single power supply in conjunction with a resistor chain can also be used, to supply the desired and sufficient potential to each laminate, electrode, and element to create the desired net motion of ions, as shown by generalized ion trajectories 162, from the ion source region 160 through the laminated openings of the high-transmission element (Lam-HTE) 300 into the funnel-focusing region 400, down the lens and exiting out through aperture 50, through the deep-well focusing region 90, through the aperture 60, and into the ion-collection region 80. Alternatively, in the case where the base 20 of the lens is comprised of dielectric material a single power supply can be used to supply the necessary potentials to the metal laminates of the lens.

Gas can be added for concurrent flow of gas from a concurrent gas source 200 introduced through a concurrent gas inlet 202. In addition, gas can be added for a countercurrent flow from a countercurrent gas source 204 through a countercurrent gas inlet 206. Excess gas can be exhausted through an exhaust outlet 210 toward an exhaust destination 208. All gas supplies are regulated and metered and of adequate purity to the meet the needs of the ion transmission application.

FIGS. 5, 6, 7—ADDITIONAL EMBODIMENTS

Figure 5:
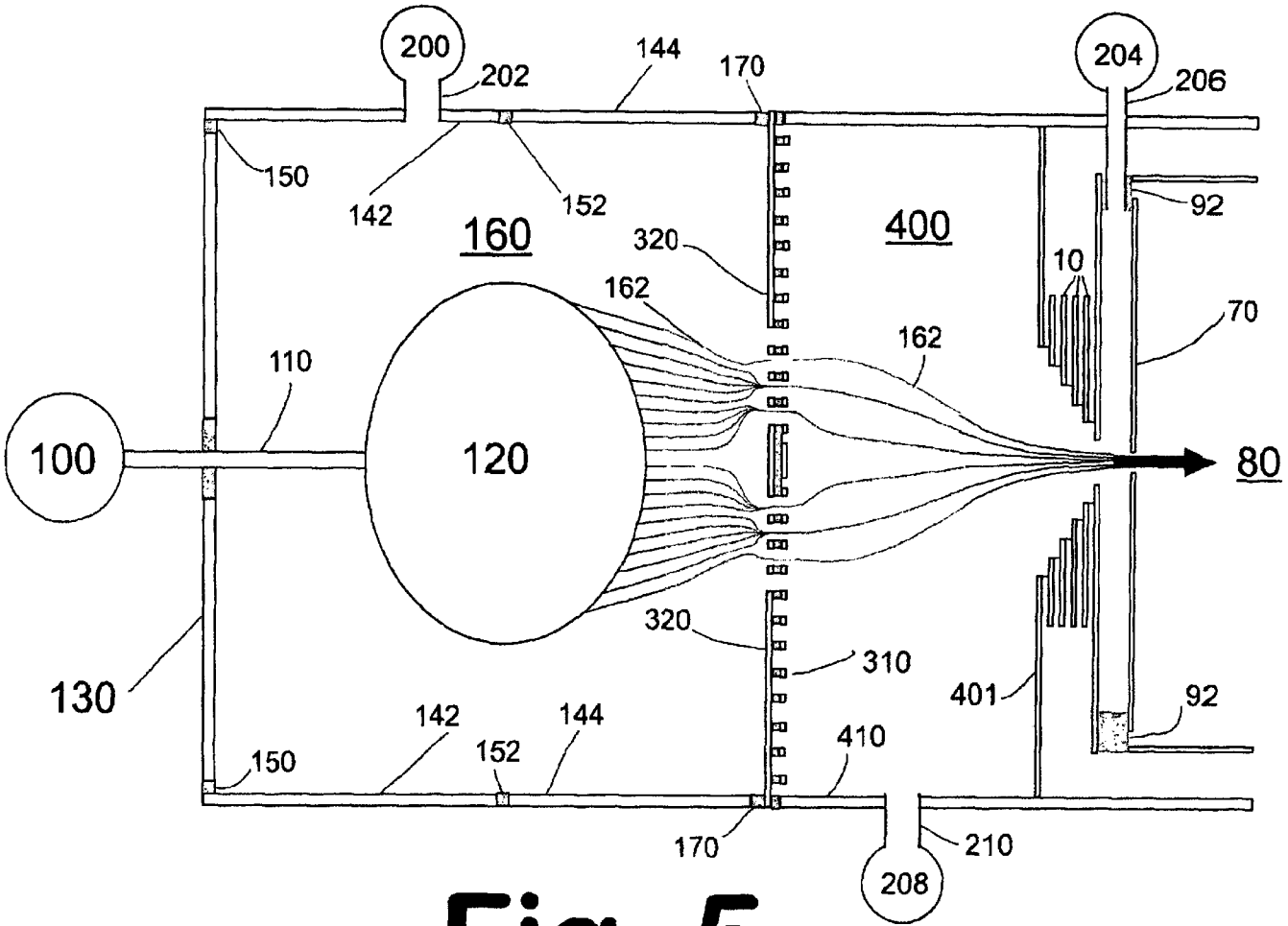
FIG. 5 shows a lens as a cross-sectional illustration of the ion source region and laminated high-transmission element (Lam-HTE) with the cylindrical lens as two separate elements.
Figure 6:
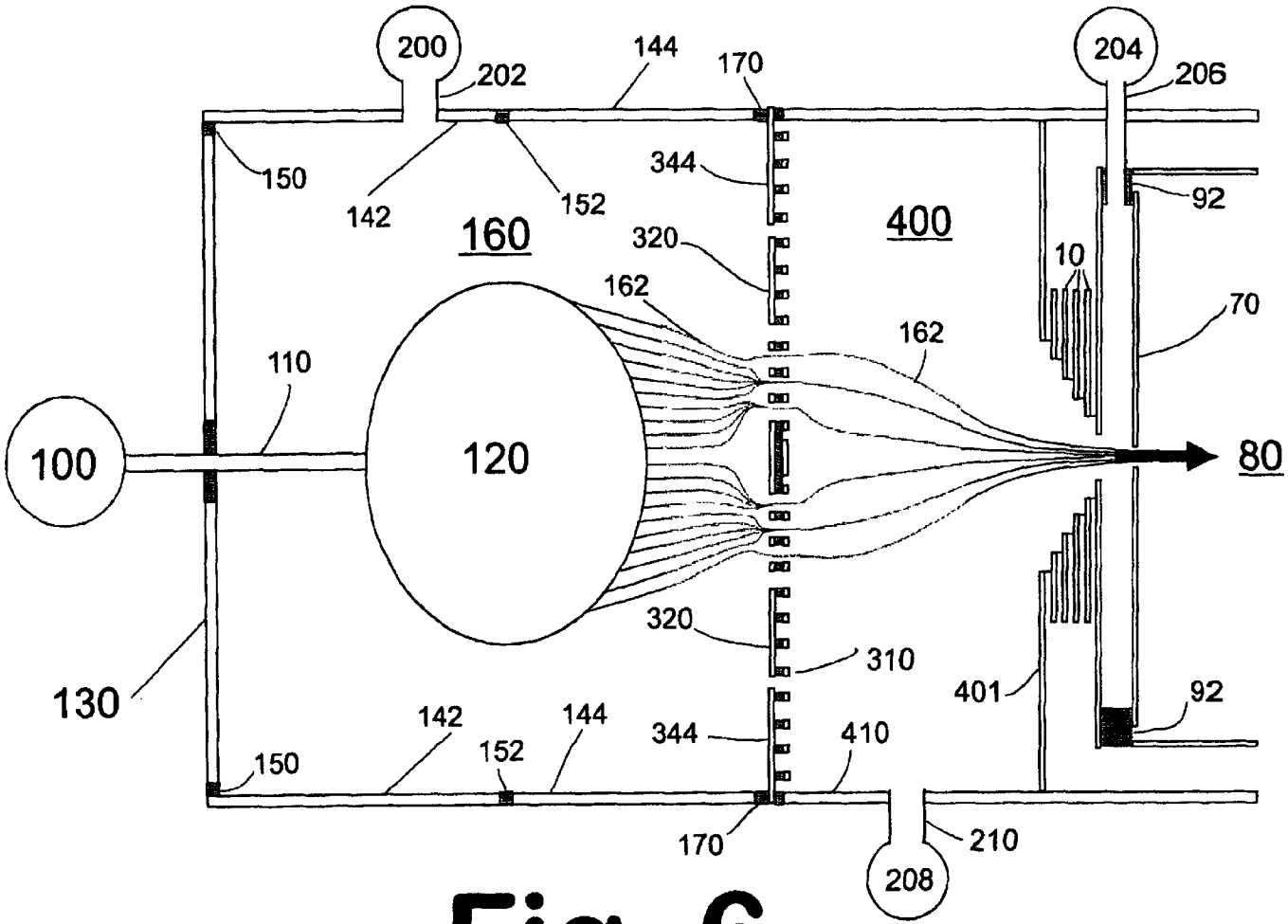
FIG. 6 shows a similar lens, ion source region, and a laminated high-transmission element (Lam-HTE), with the outer laminate as two separate surfaces.
Figure 7:
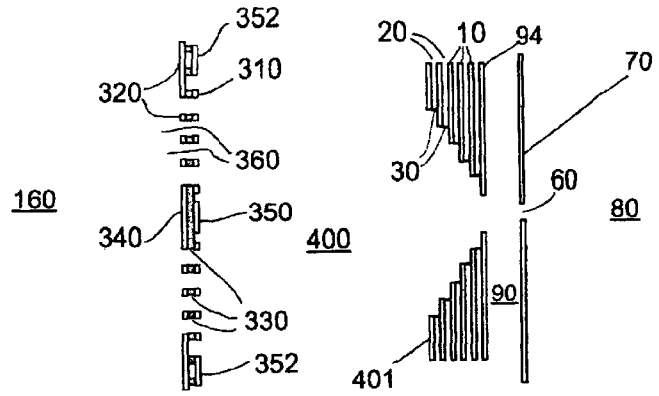
FIGS. 7A to 7C show additional means of focusing ions into the ion-funnel region (7A) the inner-laminate of the laminated high-transmission element (Lam-HTE) fabricated with additional electrodes; (7B) the cylindrical funnel wall electrically isolated from the laminated-lens and laminated high-transmission element (Lam-HTE); and (7C) a ring electrode.
Figure 7:
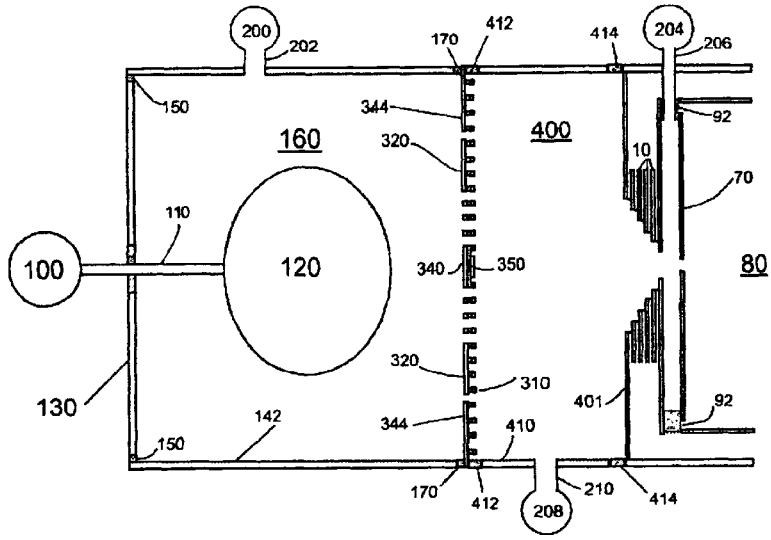
Figure 7:
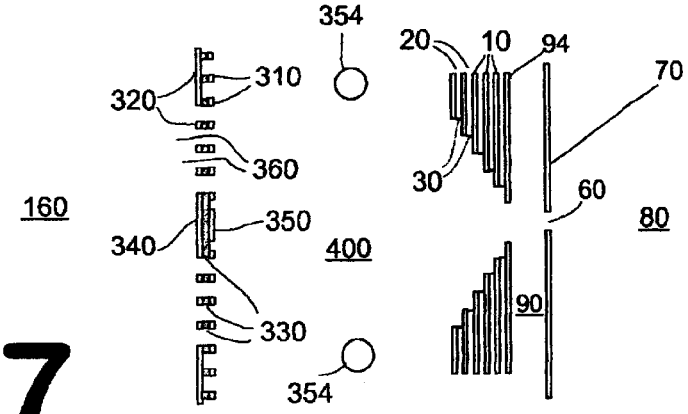

Additional embodiments of the lens are shown in FIGS. 5, 6, and 7. In FIG. 5 the cylindrical lens 140 is shown as two separate electrode, a cylindrical electrode 142 and a shielding electrode 144 separated by a ring insulator 152, and the shielding electrode 144 separated from the outer-laminate 320 by the ring insulator 170; in FIG. 6 the outer-laminate 320 is shown as two separate elements, circular metal laminates 322, 344, the circular metal laminate 322 populated with laminated openings 360 and the laminate 344 isolated from the shielding electrode 144 by the ring insulator 170; in FIG. 7A the inner-laminate 310 is fabricated with additional electrodes, a ring electrode 352 and a funnel-focusing electrode 350, which are axial-symmetric with apertures 40, 50, 60 and the particle-stop 340; in FIG. 7B the cylindrical-funnel wall 410 is isolated from the inner-laminate 310 by a ring insulator 412 and isolated from the metal laminate 401 by a ring insulator 414; and in FIG. 7C a ring electrode 354 is added to the ion-funnel region 400.

FIGS. 8 THRU 11—ALTERNATIVE EMBODIMENTS

There are various possibilities with regard to the make-up and geometry of the laminates of the lens and laminated high-transmission elements (Lam-HTE).

Figure 8:
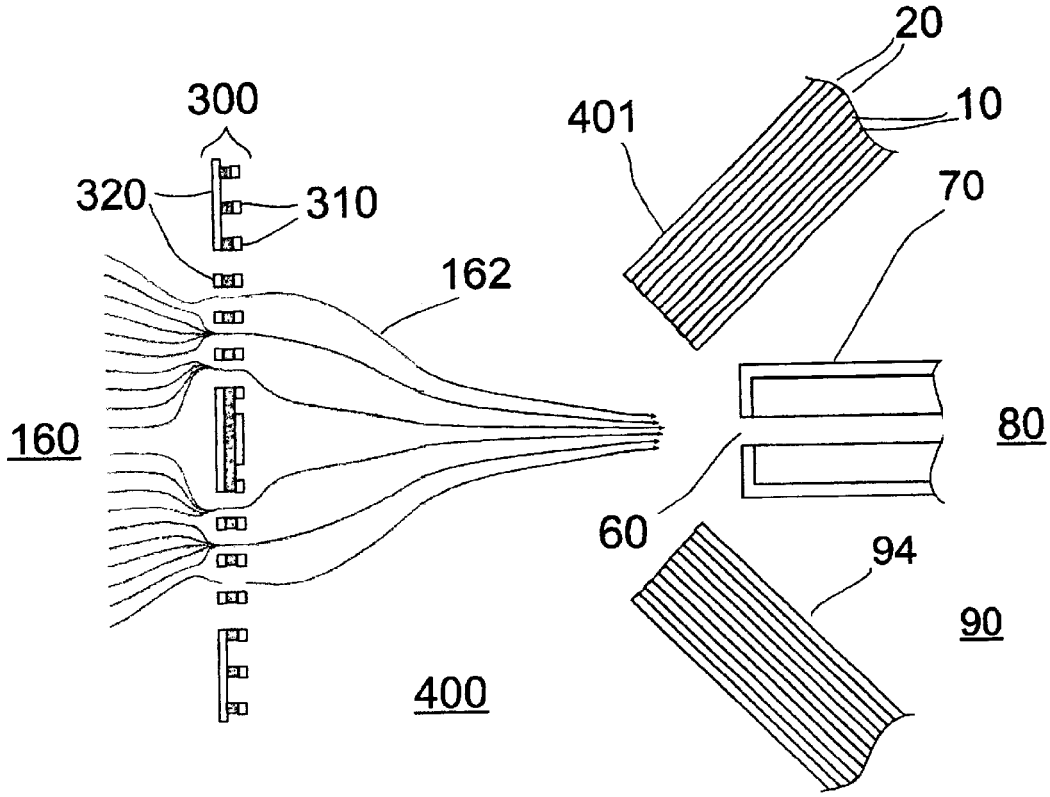
FIG. 8 shows a cone-shaped laminated lens adjacent to a laminated planar-shaped high-transmission element.

FIG. 8 shows a cross-sectional view of a lens composed of a cone-shaped array of metal laminates adjacent to a high-transmission element (Lam-HTE) 300.

Figure 9:
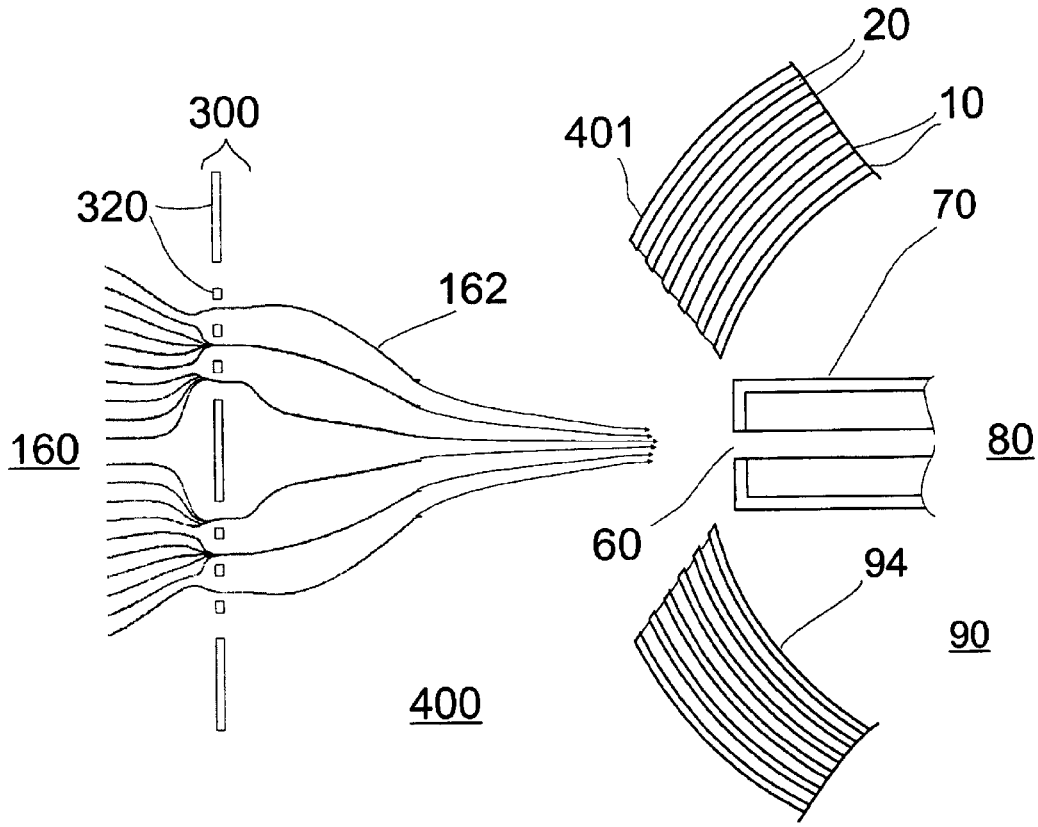
FIG. 9 shows a hemispherical-shaped laminated-lens adjacent to a planar shaped high-transmission element (Lam-HTE).

FIG. 9 shows a cross-sectional view of a lens composed of a hemispheric-shaped array of metal laminates adjacent to a planar-shaped high-transmission element 300 comprised of a single electrode 320 and an insulating base 330 partially removed; showing ion trajectories 162.

Figure 10:
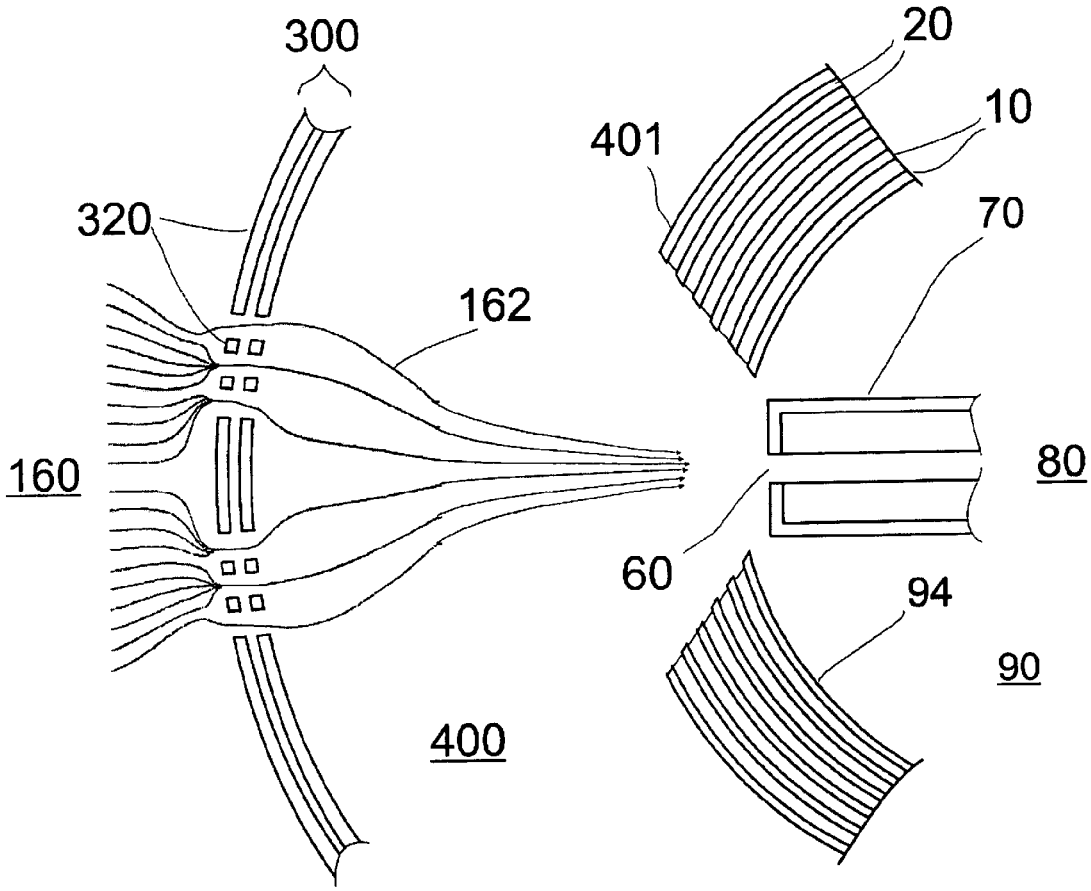
FIG. 10 shows a similar lens adjacent to a hemispheric-shaped laminated high-transmission element (Lam-HTE).

FIG. 10 shows a cross-sectional view of a similar lens adjacent to a hemispherical-shaped laminated high transmission element (Lam-HTE) 300.

Figure 11:
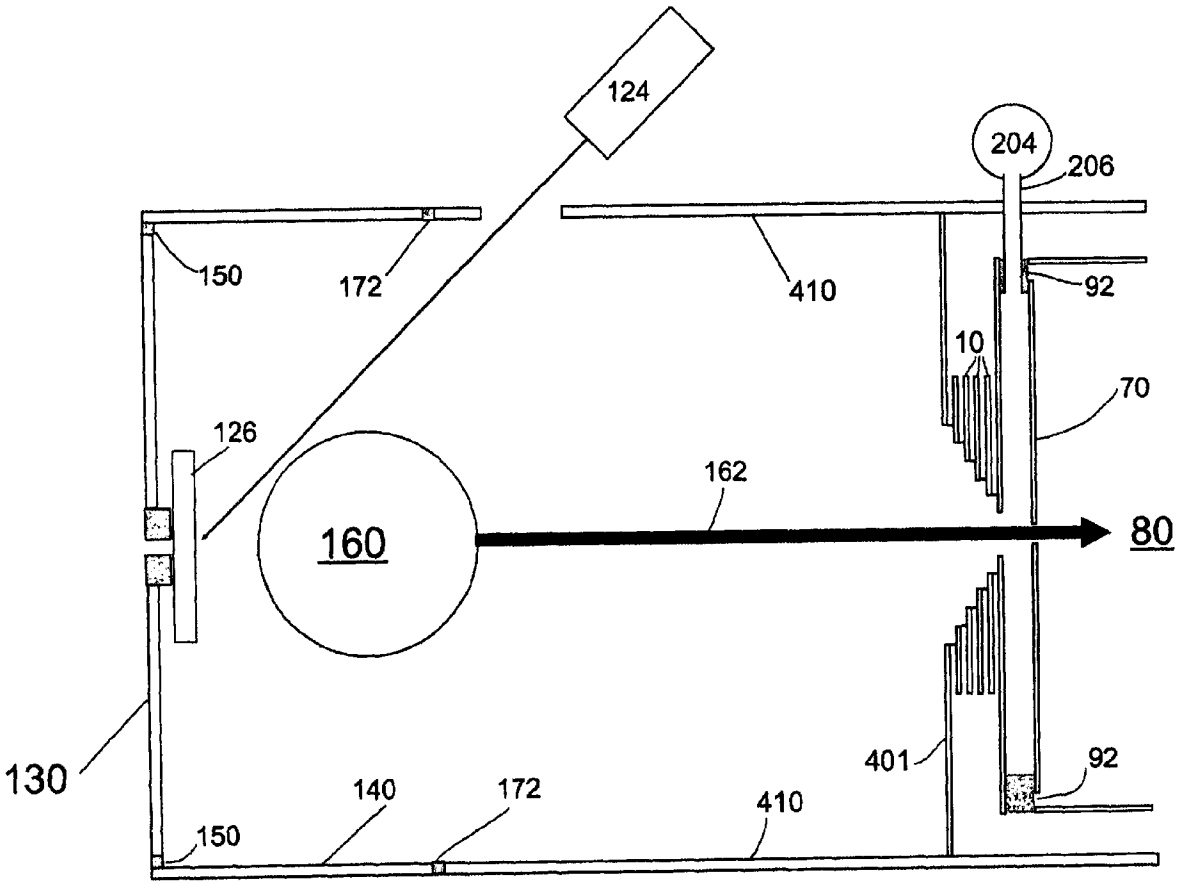
FIG. 11 shows planar-shaped lens without an adjacent laminated high-transmission element (Lam-HTE), down stream of an atmospheric matrix assisted laser desorption ionization (AP-MALDI) source.

FIG. 11 shows a cross-sectional view of a lens downstream of an atmospheric pressure matrix assisted laser desorption ionization (AP-MALDI) source including a laser 124, a sample target 126, and an ion-source 120, without a high-transmission lens sandwich between the two. The cylindrical electrode 140 separated from cylindrical funnel wall 410 by a ring insulator 172.

Operation —FIGS. 1 THRU 11

This device is intended for use in collection and focusing of ions from a wide variety of atmospheric or near atmospheric ion sources; including, but not limited to electrospray, atmospheric pressure chemical ionization, photo-ionization, electron ionization, laser ionization (including matrix assisted), inductively coupled plasma, discharge ionization. Both gas-phase ions and charged particles emanating from ion-source region 120 are collected, focused, and introduced into the vacuum system of a mass spectrometer.

Ions and charged particles supplied or generated in the ion-source region 160 are attracted to the outer-electrode surface 320 of the Lam-HTE 300 by the DC electric potential difference between the ion-source 120 and the potential on outer-electrode surface 320.

The ions moving toward the outer-electrode surface 320 and particle stop 340 are diverted away from the metal laminate surface through the laminated opening (as shown by generalized ion trajectories 162) by the presence of the electric field penetrating through the base 330 from the inner-electrode surface 310 into the ion source region 160. Making the Lam-HTE transparent to approximately all ions moving from the ion source 120 into region 400.

To move ions, that have passed through the Lam-HTE into the ion-collection region 80, lower DC electrical potentials are applied to the metal laminates 10 of the lens and the element 70 to cause ions to move into the larger aperture 40 and pass through the lens out through the smaller aperture 50, through aperture 60 of element 70, and into the ion-detection region 80.

Gas flowing in a direction that is counter to the movement of ions will serve to reduce or eliminate contamination from particulate materials and neutral gases. Operation with a counter-flow of gas is accomplished by adding a sufficient flow of gas from the countercurrent gas source 204 flowing out through the ion funnel region 400, through the laminated openings 360 and into the ion-source region 160, to prevent contamination of the outer-surface 320 of the Lam-HTE 300. In addition, lower mobility charged particles may also be swept away in the counter-flow of gas. Counter flow of gas is also a primary carrier of enthalpy required for evaporation of droplets, both charged and uncharged.

Additional means of focusing ions can be used to focus ions into the lens by fabricating the inner-laminate of the Lam-HTE 300 with additional electrodes and by placing electrodes in the ion-funnel region 400.

As shown in FIGS. 7A thru 7C, additional electrodes with DC potentials different from the DC potentials of the inner-electrode surface 310 and metal laminate 401, additional focusing can be imparted on the ions. By establishing the DC electrical potential of the funnel-focusing element 350 at a lower potential than the potentials of the inner-electrode 310 and metal laminate 410, the field lines emanating out of the ion-funnel will reach out further into the ion-funnel region 400 facilitating the movement of ions from the ion-funnel region 400 into the largest aperture 40.

Therefore, ions exiting the laminated openings can be focused down into the lens avoiding possible collisions with the metal laminates 10. Therefore, if the lens has additional focusing in the ion-funnel region 400 substantially all of the ions passing through the laminated high-transmission element 300 will be directed into the lens and be introduced into the ion-detection region 80.

The lens can be used to collect and focus ions from low-field sources, such as an atmospheric matrix assisted laser desorption ionization (AP-MALDI) ion sources; one simply configures the lens without a high-transmission element, either laminated or not. As shown in FIG. 11 when the lens is configured downstream of an AP-MALDI source, ions desorbed from the sample target 126 form a plasma of charged particles and matrix in the ion-source region 160. The charged particles in region 160 move toward the entrance aperture of the lens by means of establishing the DC electrical potentials of the lens and element 70 at a lower potential than the sample target 126 and walls 130, 140, 410. Thereby eliminating the need for a high-transmission element to shield the lens from the high fields of the ion source. In addition, the laser target 126 and walls can all be at ground potential, eliminating the need for costly interlocks to protect the analyst from high voltages.

FIGS. 8, and 9 and 10; show cone-shaped and hemispherical-shaped metal laminates of the lens focusing ions into, through aperture 60, and into ion-collection region 80, respectively.

ADVANTAGES

From the description above, a number of advantages of our laminated lens become evident:

(a) With the establishment of a low electrostatic field between the laminated high transmission surface and the laminated lens, one can shape the electrostatic field lines with a small potential apply to either the metallic layers of the laminated lens or the underside of the laminated high-transmission surface, thus avoiding the need for larger potentials required in region where the electrostatic fields from high field ion sources dominate.

(b) With the establishment of a low electrostatic field between the high transmission surface and the laminated lens, electrostatic fields lines can be focused onto a small cross-sectional area at the inlet aperture, thus avoiding the need for larger inlet apertures used to get ions into the vacuum system of a mass spectrometer.

(c) The presence of a focusing element on the underside of the laminated high-transmission surface along with the individual laminates of the laminate lens will permit time-dependent adjustment of the electrostatic fields in front of the inlet aperture.

(d) The presence of a focusing element on the underside of the laminated high-transmission surface and the potentials of the individual laminates of the laminated lens will permit the time-dependent transmission [or not] of ions through the high-transmission surface.

Conclusion, Ramification, ans Scope

Accordingly, the reader will see that the laminated lens of this invention can be used to introduce ions into the vacuum system of a mass spectrometer and can be used with both high and low electrostatic field ion sources without considering the electrostatic fields in the ion source. In addition, when the laminate lens is used to introduce ions into an inlet aperture the potentials of the laminates of the laminated lens and high-transmission surface can be optimized to shape the electrostatic field lines in front of the inlet aperture to be either converging or diverging. Furthermore, the laminated lens has the additional advantages in that:

- it provides a laminated lens which can be easily incorporated into existing high and low electrostatic field atmospheric or near atmospheric ion sources;
- it provides a laminated lens which can transfer substantially all gas phase ions from dispersive ion sources into the vacuum system of a mass spectrometer; and
- it provides a time dependent switching of the focusing and defocusing of the ions as they pass through the high transmission surface into the low electrostatic fields upstream of the laminated lens.

Although the description above contains many specifications, these should not be construed as limiting the scope of the invention but as merely providing illustrations of some of the presently preferred embodiments of this invention. For example the laminated lens can have other shapes, such as oval, square, triangular, etc.; laminated-openings can have other shapes; the number of laminates of the laminated high-transmission element can vary depending on the preferred use; the number and dimensions of both the metal laminates and insulating bases of the lens can vary depending on the source of ions, the type of ion-collection region or a combination of both, etc.

Thus the scope of the invention should be determined by the appended claims and their legal equivalents, rather than by the examples given.

We claim:

1. An apparatus for the collection and focusing of gas-phase ions at or near atmospheric pressure for the introduction of said ions into an analytical apparatus, the apparatus comprising:

a. a dispersive source of ions;

b. a stratified body comprised of a plurality of elements, said elements comprise alternating layers of metal electrodes and insulating material, each said electrode having successively smaller apertures wherein said apertures form an ion-funnel having an entry at largest aperture of first metal electrode and an exit at smallest aperture of last metal electrode, said smallest aperture forming inlet aperture into said analytical apparatus;

c. first means for maintaining a potential difference between said ion source and said metal electrode with largest aperture whereby electrostatic filed at said metal aperture with largest aperture which is equal to that required to pass substantially all said ions through said largest aperture into said ion funnel;

d. second means for maintaining a potential difference along the axis of said ion funnel whereby electrostatic fields is equal to that required to pass substantially all said ions through said ion funnel, through said inlet aperture, and into said analytical apparatus.

2. Apparatus as in claim 1 wherein said analytical apparatus comprises a mass spectrometer or ion mobility spectrometer or combination thereof.

3. Apparatus as in claim 1 wherein said inlet aperture comprises a conductive end of a capillary tube, wherein said capillary tube is the atmospheric or near atmospheric pressure inlet to the vacuum chamber of a mass spectrometer.

4. Apparatus as in claim 1 wherein said gas-phase ions are formed by means of atmospheric or near atmospheric pressure ionization, electrospray, atmospheric pressure chemical ionization, laser desorption, photoionization, or discharge ionization sources; or a combination thereof.

5. Apparatus in claim 1 further including a pure gas supplied in such a way between said inlet aperture and upstream adjacent metal laminate, whereby substantially all said gas flows into and out through said ion funnel flowing counter to trajectories of said gas-phase ions.

6. An apparatus for the collection and focusing of gas-phase ions or charged particles at or near atmospheric pressure for the introduction of said ions into the vacuum system of a mass spectrometer, the apparatus comprising:

a. a dispersive source of ions;

b. a laminated high-transmission surface populated with a plurality of openings through which substantially all said ions pass unobstructed, said laminated high transmission surface having an insulating base and metal laminate on topside and underside of said insulating base;

c. a stratified body comprised of a plurality of elements, said elements comprise alternating layers of metal and insulating laminates, each said element having successively smaller apertures wherein said apertures form an ion-funnel having an entry at the largest aperture of first metal laminate and an exit at the smallest aperture of last metal electrode said smallest aperture forming inlet aperture into said vacuum system, whereby approximately all said ions from said ion source pass unobstructed into said vacuum system of said mass spectrometer;

d. first means for maintaining a potential between said ion source and said laminated high transmission surface which is equal to that required to cause substantially all said ions from said ion source to migrate towards said metal laminate on topside of said insulating base and pass through said openings in said laminated surface, whereby electrostatic fields at said metal laminate on said underside is greater than electrostatic field at said topside of said base;

e. second means for maintaining a potential difference between said metal laminate on underside of said insulating base and said stratified body, whereby substantially all ions from said high transmission surface pass into said entry of said stratified body;

f. third means for maintaining a potential difference along the axis of said ion funnel whereby electrostatic fields is equal to that required to pass substantially all said ions through said ion funnel, through said inlet aperture, and into said vacuum system of said mass spectrometer.

7. Apparatus as in claim 6 wherein said mass spectrometer is configured with an ion mobility spectrometer, whereby ion analysis is performed in a tandem manner.

8. Apparatus as in claim 6 wherein said gas-phase ions are formed by means of atmospheric or near atmospheric ionization, electrospray, atmospheric pressure chemical ionization, laser desorption, photoionization, discharge ionization sources; or a combination thereof.

9. Apparatus in claim 6 further including a pure gas supplied in such a way between the said inlet aperture and upstream adjacent metal laminate, whereby substantially all said gas flows into and out through said entry of said ion funnel flowing through said polarity of openings in said laminated high-transmission surface flowing counter to trajectories of said gas-phase ions.

10. Apparatus in claim 6 further including funnel-focusing and ring electrodes incorporated in said metal laminate on underside of said insulating base, said funnel-focusing and ring electrodes are supplied with fourth and fifth electrostatic potentials, said funnel-focusing electrode is on-axis with said inlet aperture while said ring electrode is axial symmetric with said focusing electrode, wherein said funnel-focusing and ring electrode shape the electrostatic field lines between said high transmission surface and said entry of said ion funnel, wherein substantially all said ions passing through said laminated surface are directed into said entry of said ion funnel and pass through said ion funnel into said vacuum system of a mass spectrometer.

11. Apparatus in claim 6 further including particle stop in said metal laminate on topside of said insulating base, said particle stop is an electrode that aides in shaping the electrostatic field lines at the top surface of said laminated high transmission surface, wherein substantially all said ions are diverted away from said particle stop and pass through said laminated surface and substantially all neutral particles from said ion source impact on said particle stop.

12. A method for the collection and transfer of charged particles or ions from a highly dispersive area or source at or near atmospheric pressure and focusing approximately all said charged particles or ions into a mass spectrometer for gas-phase ion analysis, the method comprising:

a. providing a perforated laminated high-transmission surface populated with a plurality of holes made up of an insulating base and metal laminates contiguous with topside and underside of said base;

b. applying an electrostatic potential gradient across said laminated surface, such that electrostatic field lines between said ion source and said laminated surface are concentrated into said holes wherein substantially all said ions in said ion source are directed through said holes into a focusing region downstream of said laminated high-transmission surface;

c. providing electrostatic attraction to said ions in said focusing region with an electrostatic field generated by a stratified body or ion funnel, said ion funnel made up of alternating electrodes and insulating bases, each said electrode and base having successively smaller apertures, having an entry at the largest aperture of first electrode and an exit or inlet aperture at the smallest aperture of last electrode, said electrostatic attraction maintained by a potential gradient across said electrodes wherein the electrostatic potential applied to each electrode is greater than said electrostatic potential applied to adjacent or upstream electrode, such that electrostatic field lines between said laminated surface and said ion funnel are concentrated into said entry as a reduced cross-sectional area;

d. directing substantially all said ions from said focusing region into said entry and out of said inlet aperture, thereby focusing said charged particles into said mass spectrometer.

13. The method of claim 12 further comprising the step of directing ions as they exit said inlet aperture by providing electrostatic or oscillatory potentials to lens or electrodes, or combination thereof, in said mass spectrometer.

14. The method of claim 12 further comprising the step of directing a flow of gas counter to the trajectories of said ions as they are directed through said ion funnel.

15. A method for the collection and transfer of charged particles or ions from a highly dispersive area or source at or near atmospheric pressure and focusing approximately all said charged particles or ions into a mass spectrometer for gas-phase ion analysis, the method comprising:

a. providing a stratified body or ion funnel made up of alternating electrodes and insulating bases, each said electrode and base having successively smaller apertures, having an entry at the largest apertures of first electrode and an exit or inlet aperture at the smallest aperture of last electrode;

b. applying an electrostatic potential gradient across said electrodes wherein the electrostatic potential applied to each electrode is greater then said electrostatic potential applied to adjacent or upstream electrode, such that electrostatic field lines between said source of gas-phase charged particles or ions and said ion funnel are concentrated into apertures of said ion funnel;

c. directing ions from said ion source into said largest aperture and out of the inlet aperture, thereby focusing the charged particles into said mass spectrometer.

16. The method of claim 15 wherein said ions are formed in a pulsed or static fashion, or a combination thereof.

17. The method of claim 15 wherein said method further includes the step of operating said ion source in an oscillatory fashion by providing oscillatory electrical potentials to said ion source.

18. The method of claim 15 wherein said method further includes the step of directing ions as they exit said inlet aperture by providing electrostatic and oscillatory potentials to lens or electrodes in said mass spectrometer.

19. The method of claim 15 wherein said method further includes the step of directing a flow of gas counter to the trajectories of said ions as they are directed through said ion funnel.

* * * * *